US007607403B2

(12) United States Patent
Walters

(10) Patent No.: US 7,607,403 B2
(45) Date of Patent: Oct. 27, 2009

(54) METHOD OF PROVIDING SCORING INFORMATION AT A WRESTLING MEET

(76) Inventor: John D. Walters, 602 S. Stone, Creston, IA (US) 50801

( * ) Notice: Subject to any disclaimer, the term of this patent is extended or adjusted under 35 U.S.C. 154(b) by 208 days.

(21) Appl. No.: 11/535,519

(22) Filed: Sep. 27, 2006

(65) Prior Publication Data

US 2008/0072814 A1 Mar. 27, 2008

(51) Int. Cl.
*A63F 1/18* (2006.01)

(52) U.S. Cl. ..... 116/222; 116/223; 116/225; 116/309; D10/46.1; 340/323 R

(58) Field of Classification Search ..... 116/222, 116/223–224, 309, 311, 313, 316, 318; D10/46.1; 340/323 R, 815.53, 815.54; 40/452, 564, 40/575, 576; 345/33
See application file for complete search history.

(56) References Cited

U.S. PATENT DOCUMENTS

D167,094 S * 6/1952 Baumann ..... D10/46.1
2,669,389 A * 2/1954 Mesi et al. ..... 377/5
3,104,484 A * 9/1963 Wood ..... 40/452
D218,344 S * 8/1970 Myers ..... D10/40
3,727,213 A * 4/1973 Kurtenbach ..... 340/323 R
3,737,889 A * 6/1973 Sweeny ..... 340/323 R
D229,076 S * 11/1973 Kurtenbach ..... D10/46.1
3,943,505 A * 3/1976 Berzin et al. ..... 340/323 R
4,045,788 A * 8/1977 Castelli et al. ..... 340/323 R
4,133,289 A * 1/1979 Beattie ..... 116/309
4,164,910 A * 8/1979 Feiler ..... 116/225
4,592,546 A * 6/1986 Fascenda et al. ..... 463/29
5,531,453 A * 7/1996 Penston, III ..... 273/440
5,620,099 A * 4/1997 Bickett et al. ..... 206/579
5,653,634 A * 8/1997 Hodges ..... 700/91
5,894,261 A * 4/1999 Green ..... 340/323 R
6,076,021 A * 6/2000 Houriet et al. ..... 700/93
6,135,881 A * 10/2000 Abbott et al. ..... 463/3
6,162,129 A * 12/2000 Nielsen ..... 473/131
6,536,041 B1 * 3/2003 Knudson et al. ..... 725/39
7,117,619 B1 * 10/2006 Huber ..... 40/495
7,248,888 B2 * 7/2007 Inselberg ..... 455/517
7,303,472 B2 * 12/2007 Guagliardo ..... 463/40
7,340,765 B2 * 3/2008 Feldmeier ..... 725/92
2002/0152245 A1 * 10/2002 McCaskey et al. ..... 707/530
2002/0178049 A1 * 11/2002 Bye ..... 705/11
2003/0146574 A1 * 8/2003 Duhamel ..... 273/292
2004/0117831 A1 * 6/2004 Ellis et al. ..... 725/53
2006/0252525 A1 * 11/2006 Walker et al. ..... 463/29
2008/0088421 A1 * 4/2008 McMillan et al. ..... 340/323 R

* cited by examiner

*Primary Examiner*—R. A. Smith
*Assistant Examiner*—Tania C Courson

(57) ABSTRACT

A method of providing team scoring information at a wrestling meet. This method includes providing a scoring device with team names and a team score associated with each team name. Information related to the wrestling match is then inputted into the scoring device and the team score is updated as the information is inputted. Additionally, the scoring device allows spectators to view what weight classes have been completed.

17 Claims, 2 Drawing Sheets

METHOD OF PROVIDING SCORING INFORMATION AT A WRESTLING MEET

BACKGROUND OF THE INVENTION

This invention relates to a method of providing scoring information at a wrestling meet. More specifically, the invention relates to a method of team scoring that continually updates team scores throughout a wrestling meet.

In wrestling meets there are a plurality of weight classes wherein a wrestling team typically provides wrestlers for each weight class in the meet. Then the wrestlers in each weight class compete in their own separate tournament with wrestlers from other teams in their weight class. Depending on the size of the meet, a tournament may have a winners bracket and a losers bracket, or wrestle back brackets. These brackets determine the place of each wrestler. During these weight class tournaments individual wrestlers score points for their team for winning matches and gain bonus points depending on how they win their match. Specifically team bonus points are typically rewarded for pins, technical falls or major decisions. Other scoring systems sometimes include bonuses for matches won by default, disqualification or forfeit. For example, for a first round match if a wrestler wins by a pin he receives 3 team points for the win and an additional 2 bonus team points for the pin for a total of five team points. The loser of the match meanwhile will not be allotted any points.

At most high school tournaments the fans are not informed of a team's score until at least after the first round of each individual tournament is finished. Usually the score is announced over the PA system and sometimes a scoreboard is manually raised to show the fans the team scores. However, scores are not always constantly updated and occasionally PA announcers are difficult to understand.

As a result of team results not constantly being updated often times wrestlers and fans alike are left not realizing the significance of matches. For example only, an instance could occur in a 16 team event where with two weight classes left in competition as many as four, if not more, teams could be in contention for winning the overall team point total. However, because adequate team wrestling scoreboards are not available, there is no way for the individual wrestlers or their fans to realize the significance of the matches they are partaking in. Thus, the potential excitement of the crowd and extra edge of competitors is curbed. Additionally errors occur in scoring that are not caught until days after a meet, creating controversy as to the legitimacy of meet.

Thus, it is a principal object of the present invention to provide a method of providing team scoring information at a wrestling meet.

Yet another object of the present invention is to provide a method of providing scoring information that is able to constantly update.

These and other objects, features, or advantages of the present invention will become apparent from the specification and the claims.

BRIEF SUMMARY OF THE INVENTION

A method of providing team scoring information at a wrestling meet. The method includes providing a scoreboard having a plurality of team names thereon and providing a team score associated with each team name. The method also involves inputting information related to wrestling match results thereon and updating the team score based upon the inputted information related to wrestling match results.

DETAILED DESCRIPTION OF THE PREFERRED EMBODIMENT

Figure 1:
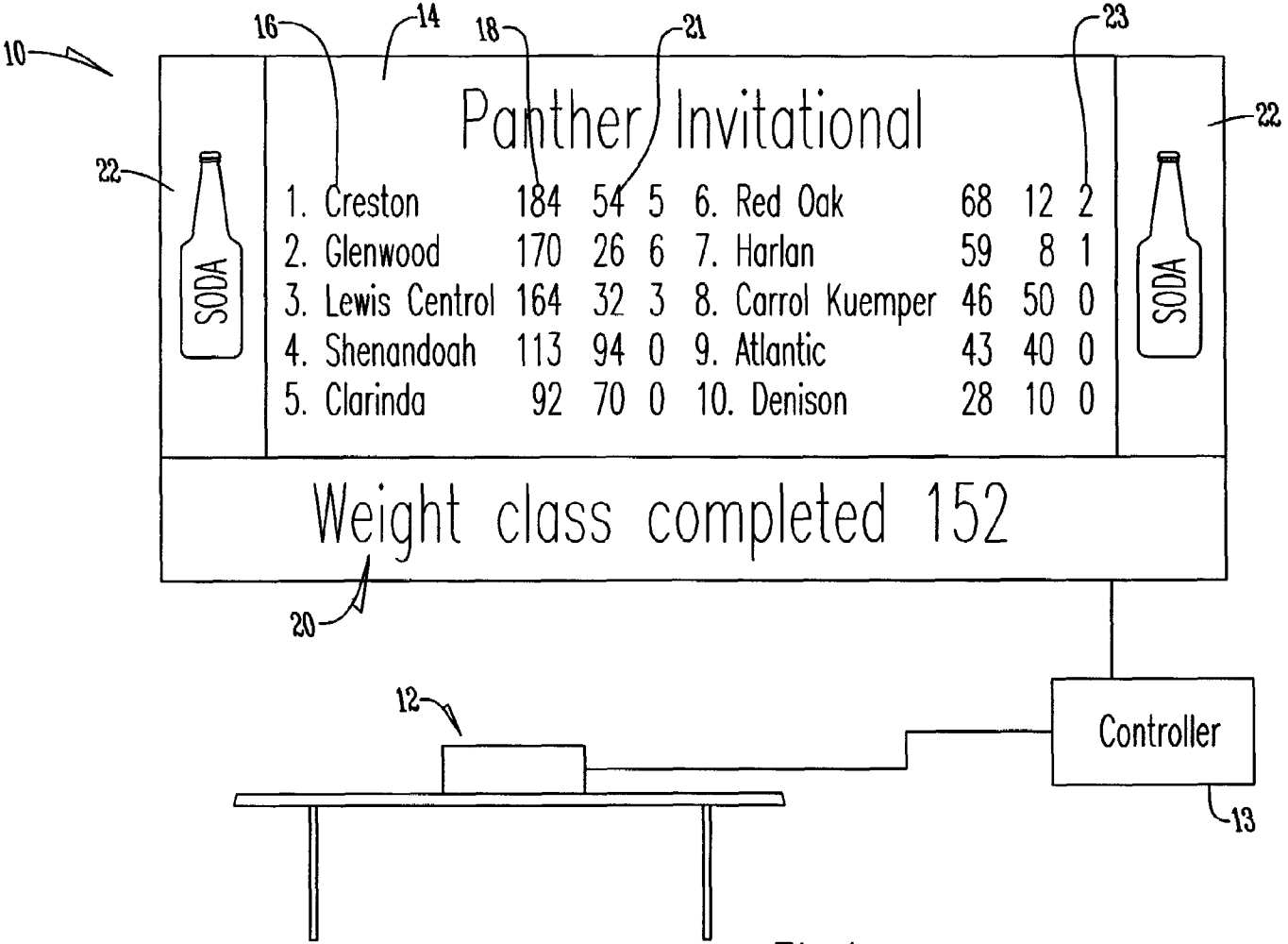
FIG. 1 is an electronic scoreboard at a wrestling meet.

FIG. 1 shows a scoreboard 10 set up above and electrically connected to a scorers table 12 where an input can be transmitted into the scoreboard 10. Though shown in this embodiment above the scorers table 12 the scoreboard 10 can be placed at any location as long as the scoreboard 10 remains electrically connected to the scorers table either remotely/wirelessly or through hard wiring to a controller 13.

The scoreboard itself 10 has a display screen 14 that contains a plurality of team names 16. Adjacent each team name 16 on the display screen 14 is a team score 18 that is associated with the team name 16. The team name 16 may be arranged in any manner such as alphabetically or by ascending or descending manner in relation to the team score 18 accrued. Additionally, the display screen 14 has weight class identification 20 thereon to indicate the most recent weight class completed such that spectators know the state of the current scoring. Additionally, advertising areas 22 may be placed on either side of the display screen 14. Also the points earned for a particular match 23 are displayed adjacent the team 16. Thus, as match results are received at the scorer's table 12 information regarding the results are inputted into the controller 13 and the display on the scoreboard regarding team scores and the weight classes completed. The controller may also calculate and the scoreboard display potential points 21 still possible for each team.

Figure 2:
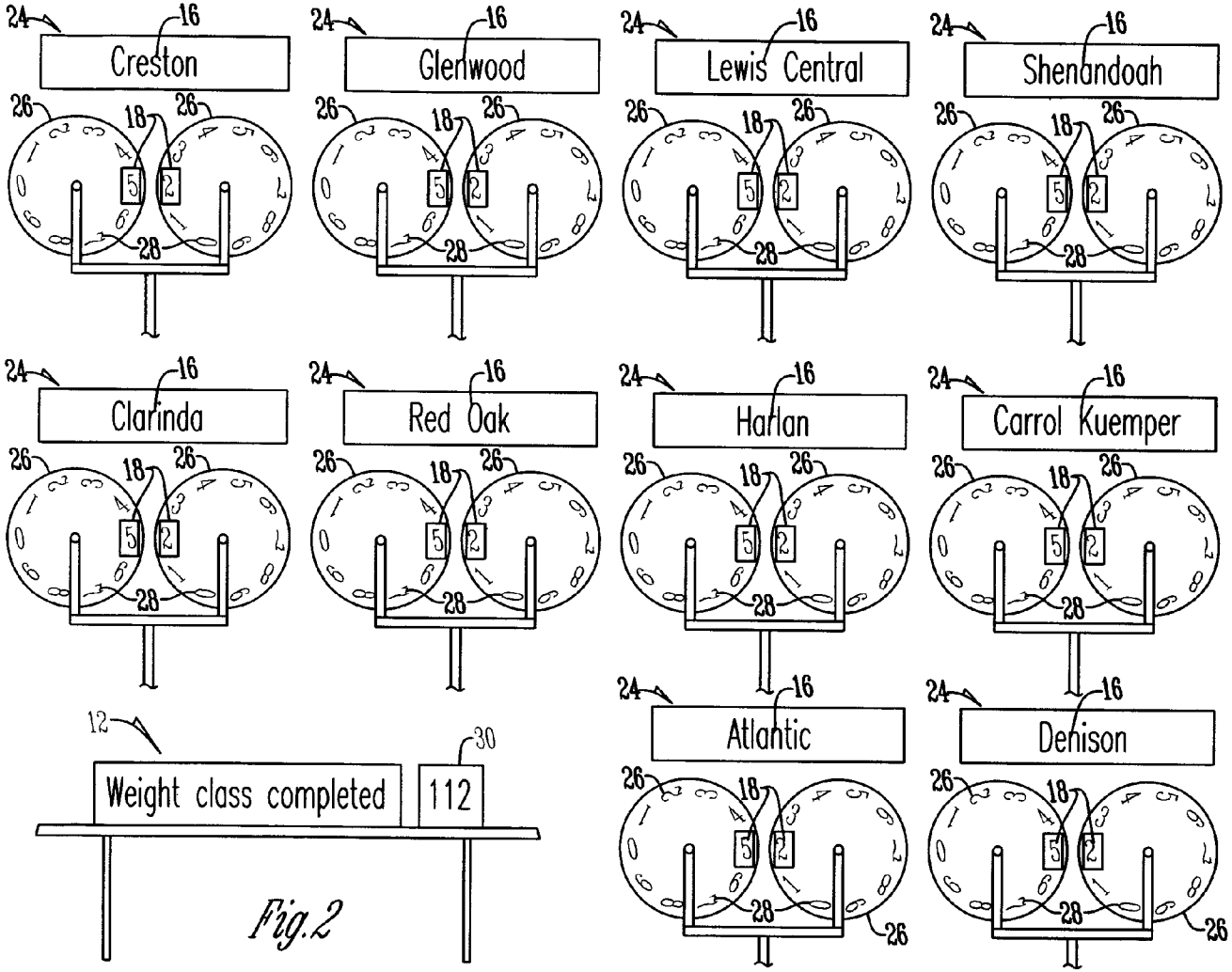
FIG. 2 is a manually operated team scoreboard at a wrestling meet.

FIG. 2 shows an alternative embodiment of the present invention. In this embodiment the method is accomplished by using a plurality of score cards 24 wherein each team in a wrestling meet has a score card 24. For example only, the score cards could be a pair of circular wheels 26 having numerals 28, zero through nine thereon, that are placed side by side such that the first and second numerals in a score may be changed. For instance, in the embodiment seen in FIG. 2 the score card 24 in slot one shows a score of 52. Though shown as a pair of wheels 26 in this embodiment, other embodiments including numerals that may be manually flipped may be used. Thus, team scores can be manually updated by individuals at the scoring table 12. Again, as in the embodiment of FIG. 1 the score cards can be arranged alphabetically or in ascending or descending order dependent on team score 18. Additionally, a weight class score card 30 can also be displayed such that spectators and wrestlers know what weight classes have been calculated into the scoring.

In operation, using either embodiment as seen in FIG. 1 or 2, a method for providing team scoring information at a wrestling meet is provided. This method involves providing a scoreboard 10 having team names 16 thereon and providing a team score 18 associated with each team name 16. The method also includes inputting information related to wrestling match results into the controller 13 for display on the scoreboard 10. This can be done either manually by rotating the wheels 26 or by typing or inputting information into an electrical system that is in communication with an electric scoreboard 10 through the controller. The next step requires updating the team score 18 based upon the information inputted related to the wrestling match results. Thus, as a wrestling match is completed the team points associated with the match may be inputted into the controller 13.

The method can further comprise arranging the team names either alphabetically or in ascending or descending order according to team score 18. Additionally, the method includes providing which weight classes have been completed in the meet with the scoring device, thus allowing a spectator to know the up to date team score totals. Also, the possible points 21 remaining for each team are calculated and displayed on the scoreboard 10. Therefore, when several teams are in contention for winning a team title with only a couple of weight classes left remaining in a wrestling meet, spectators are apprised of the situation. This ensures maximum fan participation and competitor awareness. Additionally, by constantly updating scores that all spectators can watch, errors in scoring are additionally minimized as fans and coaches can point out scoring mistakes. Thus, at the very least all the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A method of providing team scoring information at a wrestling meet comprising the steps of:

providing a scoring device at a wrestling meet simultaneously displaying at least three team names thereon;

providing a team score associated with each team name;

inputting information related to wrestling match results into the scoring device after each match;

updating each team score based upon the information inputted related to the wresting match results immediately after the information related to the wrestling match results is inputted into the scoring device, and indicating with the scoring device when a wrestling weight class is complete.

2. The method of claim 1 wherein the team score is updated electronically.

3. The method of claim 1 wherein the team score is updated manually.

4. The method of claim 1 wherein the team names are arranged alphabetically on the scoreboard.

5. The method of claim 1 wherein the team names are arranged in descending order according to the team score.

6. The method of claim 1 wherein the team names are arranged in ascending order according to the team score.

7. The method of claim 1 wherein advertising is provided on the scoreboard.

8. The method of claim 1 wherein the scoring device is an electronic scoreboard.

9. The method of claim 1 further comprising the steps of calculating possible points remaining for each team and displaying the calculated points on the scoreboard.

10. The method of claim 1 wherein the scoring device is electrically connected to a scorer's table.

11. The method of claim 1 wherein the scoring device is hard wired to a scorer's table.

12. The method of claim 1 further comprising the steps of inputting information regarding results into a controller as results are received at a scorer's table.

13. The method of claim 12 further comprising the steps of updating the team score and the weight classes completed on the scoring device.

14. A method of providing team scoring information at a wrestling meet comprising the steps of:

providing a scoring device at a wrestling meet simultaneously displaying at least three team names thereon;

providing a team score associated with each team name;

inputting information related to wrestling match results into the scoring device after each match;

updating each team score based upon the information inputted related to the wrestling match results immediately after the information related to the wrestling match results is inputted into the scoring device, and indicating with the scoring device when a wrestling weight class is complete wherein the scoring device is a plurality of score cards.

15. The method of claim 14 wherein the score cards comprise a pair of adjacent wheels each having numerals thereon.

16. The method of claim 14 wherein the scoring device has a weight class score card that indicates when the wrestling weight class is completed.

17. A method of providing team scoring information at a wrestling meet comprising the steps of:

providing a scoring device at a wrestling meet having at least three team names thereon;

providing a team score associated with each team name;

inputting information related to wrestling match results into the scoring device after each match;

updating each team score based upon the information inputted related to the wresting match results immediately after the information related to the wrestling match results is inputted into the scoring device; and indicating with the scoring device when a wrestling weight class is complete; and indicating with the scoring device the potential points for each team.

* * * * *